US011713950B1

(12) United States Patent
Reed

(10) Patent No.: US 11,713,950 B1
(45) Date of Patent: Aug. 1, 2023

(54) PRIMER SEATING TOOL

(71) Applicant: Jesse Reed, Redford, NY (US)

(72) Inventor: Jesse Reed, Redford, NY (US)

( * ) Notice: Subject to any disclaimer, the term of this patent is extended or adjusted under 35 U.S.C. 154(b) by 0 days.

(21) Appl. No.: 18/148,674

(22) Filed: Dec. 30, 2022

Related U.S. Application Data

(60) Provisional application No. 63/317,694, filed on Mar. 8, 2022.

(51) Int. Cl.
*F42B 33/04* (2006.01)

(52) U.S. Cl.
CPC ..... *F42B 33/04* (2013.01)

(58) Field of Classification Search
CPC ..... F42B 33/04
USPC ..... 86/36
See application file for complete search history.

(56) References Cited

U.S. PATENT DOCUMENTS 3,205,762 A * 9/1965 Parke ..... F42B 33/04 86/36
4,429,610 A * 2/1984 Mantel ..... F42B 33/004 86/36
4,590,841 A * 5/1986 Davis ..... F42B 33/04 86/36
5,025,706 A * 6/1991 Markle ..... F42B 33/04 86/36
5,198,606 A 3/1993 Storstad et al.
5,693,905 A 12/1997 Blodgett et al.
6,260,463 B1 7/2001 Brand et al.
6,862,831 B1 * 3/2005 Canaday ..... F41A 17/44 42/70.07
9,303,965 B1 4/2016 Dykstra
2007/0256864 A1 * 11/2007 Robichaux ..... E21B 17/1007 175/57
2014/0090854 A1 * 4/2014 Robichaux ..... E21B 33/076 166/351

(Continued)

FOREIGN PATENT DOCUMENTS

FR 2567439 A * 1/1986 ..... F42B 33/04
GB 2188130 A * 9/1987 ..... F42B 33/04

OTHER PUBLICATIONS

Arectech After Work, "RGBS Bench Priming Tool", Jan. 13, 2022, YouTube, Entire Video, <https://www.youtube.com/watch?v=31A4dGFWn5g>. (Year: 2022).*

(Continued)

*Primary Examiner* — Jonathan C Weber
(74) *Attorney, Agent, or Firm* — Stgip, LLC; Shawn Gordon

(57) ABSTRACT

A system for improving the accuracy of the seating of primers in primer pockets of shell casings while avoiding damaging the end of the shell casing is provided. A stop mechanism that directly engages the bottom of the shell is included such that, as the primer is inserted into the primer pocket, more accurate seating depth is ensured. In addition, the seating depth may be adjusted in order to compensate for changes over time, which may be due to changes in materials or wear. Further, components that interact with the end of the shell casing and rod have increased thickness to add strength and provide more surface area relative to the base of the shell casing, thus reducing the chance that the base of the shell casing is bent and allowing for a precise stopping position during priming.

11 Claims, 8 Drawing Sheets

(56) References Cited

U.S. PATENT DOCUMENTS

2015/0053071 A1* 2/2015 Holland ..... F42B 33/04
86/36

OTHER PUBLICATIONS

Dgunnut, "RGBS Automatic Priming Tool", Mar. 31, 2019, YouTube, Entire Video, <https://www.youtube.com/watch?v=brK7xtoCde4&t=276s>. (Year: 2019).*

RCBSReloading, "RGBS® FAQ: Assemble and use the RGBS Automatic Priming Tool", Oct. 7, 2011, YouTube, Entire Video, <https://www.youtube.com/watch?v=59oL4aDvhFI&t=63s>. (Year: 2011).*

* cited by examiner

PRIMER SEATING TOOL

FIELD OF THE INVENTION

The present invention generally relates to ammunition loading systems, and more specifically to a tool for accurately and conveniently loading primers into ammunition cartridge cases.

BACKGROUND

Ammunition for a firearm typically includes a bullet projectile seated within a shell or cartridge case. The shell is a hollow cylinder with an open end sized to accept a bullet, and a closed end that includes a pocket for receiving a primer that contains a small portion of combustible material. When the firearm is discharged, a firing pin of a hammer strikes the primer in the pocket of the shell, which forces an anvil into the primer, compressing and thus igniting the combustible material in the primer.

To reduce costs and/or to control the quality of loading/reloading, firearm operators may wish to load primers into the primer pockets of shells. To do this, any spent primer must be removed and a new primer is inserted into the empty primer socket. Devices have been developed to assist with these processes.

For example, U.S. Pat. No. 5,198,606, discloses a device for removing a spent primer and then pushing a replacement primer out of a holder to transfer the primer to the primer socket. Similarly, U.S. Pat. No. 5,693,905 discloses a priming station for loading a primer into a primer pocket of an ammunition cartridge case that includes a track for guiding a primer strip through the priming station. U.S. Pat. No. 9,303,965 discloses a device for consistent placement of a primer in an ammunition shell in which full extension of a loading pin is limited by an obstruction in the path of a ram rod. However, there is a need for a tool for conveniently loading primers into a primer socket of a shell with increased accuracy.

SUMMARY OF THE DISCLOSURE

A primer seating device includes a shell casing holder for receiving a shell casing, wherein the shell casing has a bottom end, the bottom end having a shell casing end diameter, and a primer pocket at the bottom end; a rod having a top end and a bottom end, the rod including a threaded hole running from the top end toward the bottom end, wherein the rod has a diameter that is smaller than the shell casing end diameter; a primer seating stem having a top portion and a bottom portion, wherein the bottom portion includes a threaded portion and is configured to be received by the threaded hole and wherein the top end is encompassed by a primer holder, the primer holder having a top edge and a bottom edge, and having an outer diameter equal to the diameter of the rod; a spring surrounding a portion of the primer seating stem from the top portion of the primer seating stem to a lower portion located within the rod when the primer seating stem is secured in the rod; and a lever positioned beneath the rod and configured to raise the rod toward the shell casing holder when actuated. When the rod is raised by the lever, the rod and primer seating stem move upward until the top edge of the primer holder engages the shell casing end and the bottom edge of the primer holder engages the top end of the rod such that upward motion of the rod is terminated.

A primer seating device is provided for seating a primer in a shell casing, the shell casing including a bottom end and a primer pocket. The primer seating device includes a shell casing holder for receiving the shell casing; a rod having a top end and a bottom end, the rod including a threaded hole running from the top end toward the bottom end, wherein the top end includes a top edge; a primer seating stem having a top portion and a bottom portion, wherein the bottom portion includes a threaded portion and is configured to be received by the threaded hole and wherein the top end is configured to support the primer; a primer holder configured to surround the top portion of the primer seating stem and support the primer, wherein the primer seating stem is configured to move upwardly with respect to the primer holder; a locking ring between the rod and the primer holder, wherein a portion of the primer seating stem passes through the locking ring, wherein the locking ring is rigidly secured to the top end of the rod, and wherein the locking ring includes a top surface; a spring surrounding a portion of the primer seating stem from the top portion of the primer seating stem to a lower portion of the primer seating stem located within the locking ring; and a lever positioned beneath the rod and configured to raise the rod toward the shell casing holder when actuated. When the rod is raised by the lever, the top surface of the locking ring engages a bottom surface of the primer holder and a top surface of the primer holder engages the bottom end of the shell casing when the shell casing is in the shell casing holder such that upward motion of the rod is terminated.

A primer seating device includes a shell holder configured to receive a shell, wherein the shell includes a primer pocket and a bottom rim surrounding the primer pocket, wherein the shell holder is configured to secure the shell such that the primer pocket is oriented toward the shell holder, and wherein the shell holder includes an opening aligned with the primer pocket when the shell is in the shell holder; a stem configured to move from a first position to a second position, the stem having a diameter, a threaded lower portion, and a top portion being wider than the diameter of the stem; a primer holder configured to hold a primer and including a top surface and a lower surface and configured to receive the stem, wherein, when the stem is in the primer holder, the top portion of the stem is supported by the primer holder when the stem is in the first position and the stem is configured to move with respect to the primer holder into the second position; a locking ring through which the threaded lower portion of the stem runs; and a rod having an upper surface and a threaded hole configured to receive the threaded lower portion of the stem. A maximum extent of the second position is limited by engagement of the upper surface of the rod with the lower surface of the primer holder and the top surface of the primer holder with the bottom rim of the shell when the shell is in the shell holder.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

Figure 1:
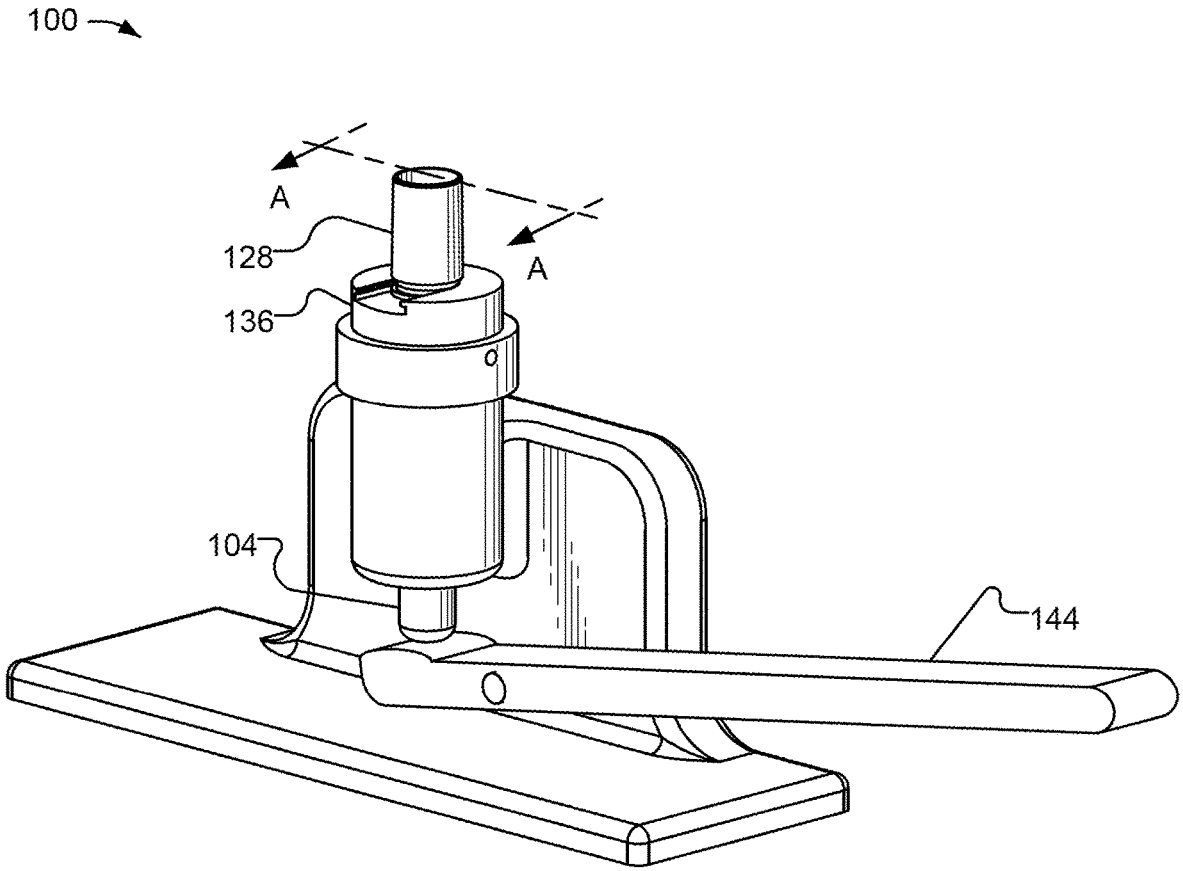
FIG. 1 is a perspective view of a primer loading tool in accordance with an embodiment of the present invention.
Figure 2:
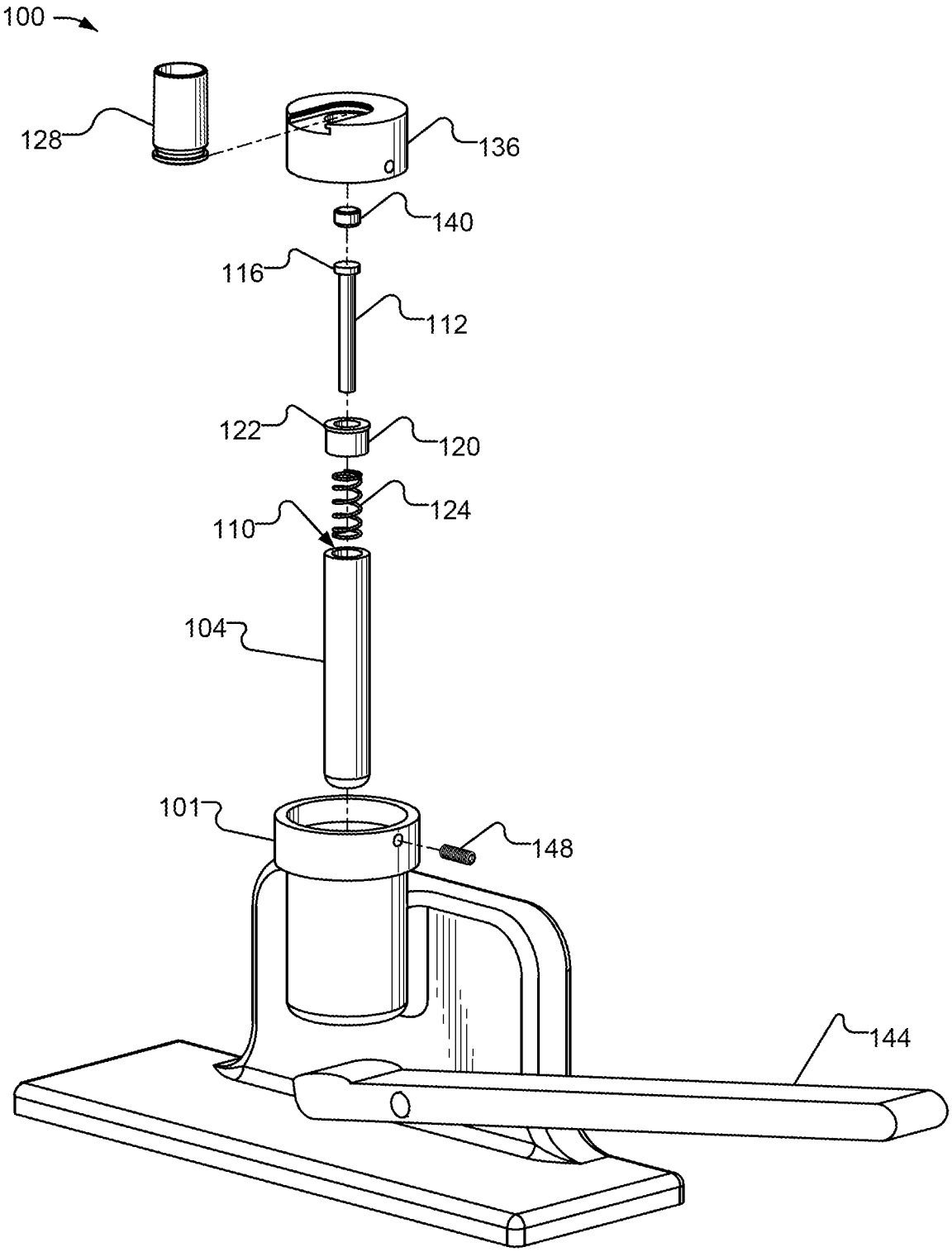
FIG. 2 is an exploded view of the primer loading tool of FIG. 1.
Figure 3:
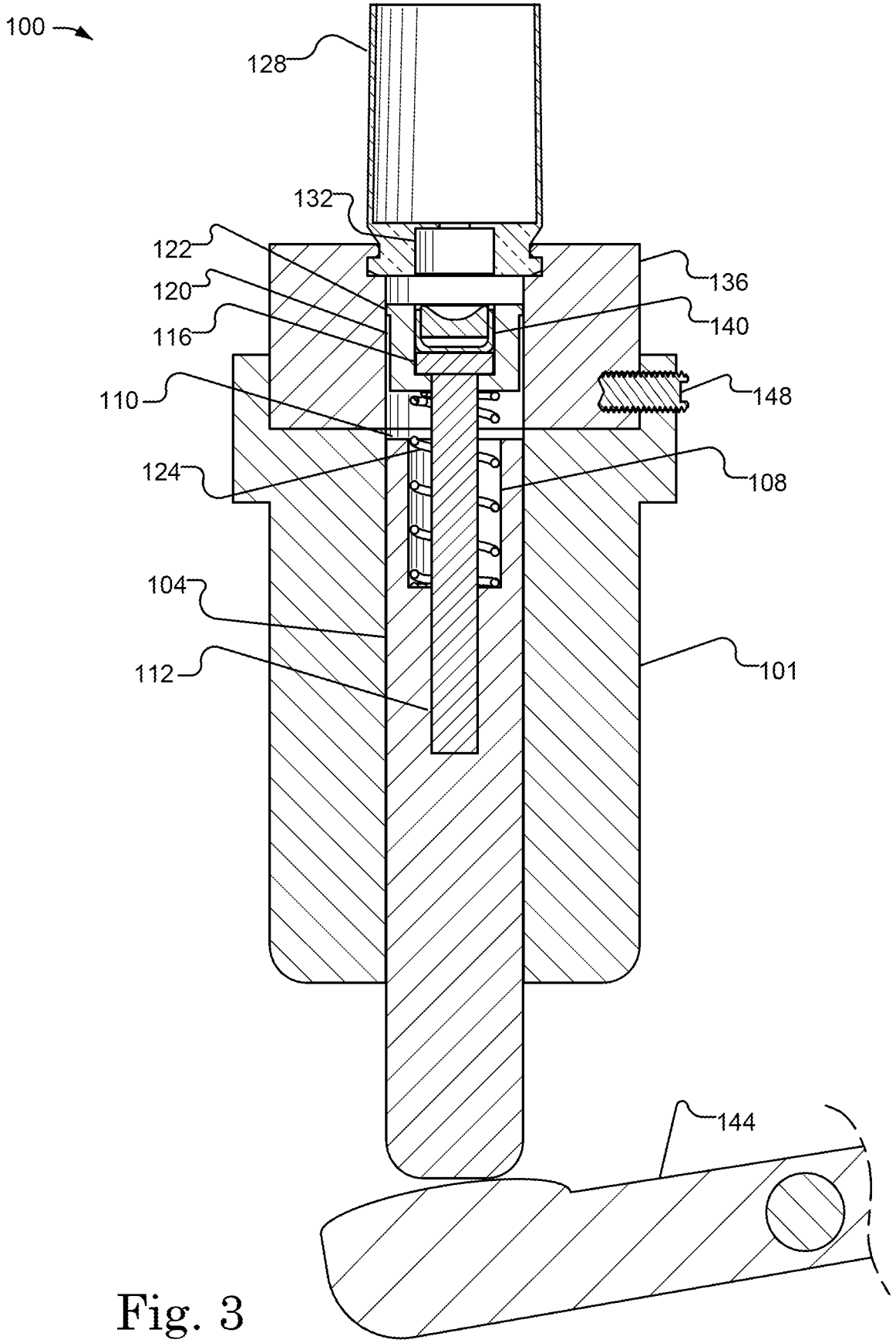
FIG. 3 is a cutaway view of a portion of the primer loading tool of FIG. 1.
Figure 4C:
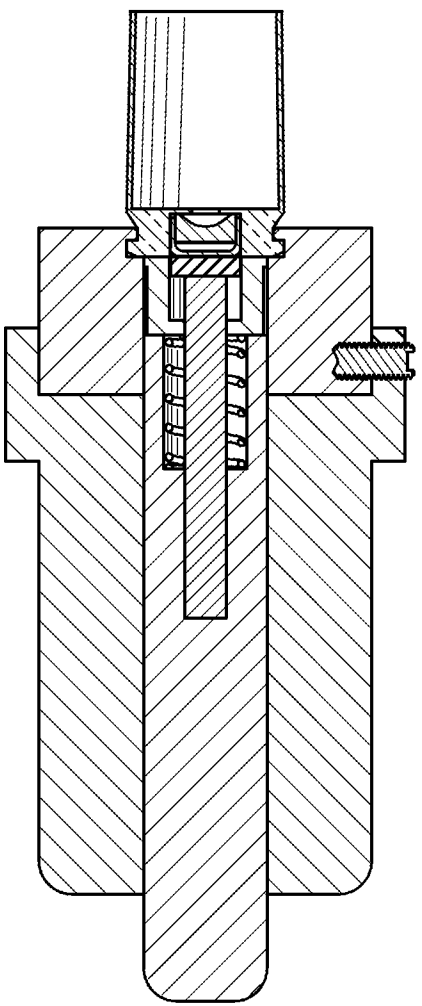
FIGS. 4A-4C are cutaway views of a portion of the primer loading tool of FIG. 1 showing different stages in the primer loading sequence.
Figure 4B:
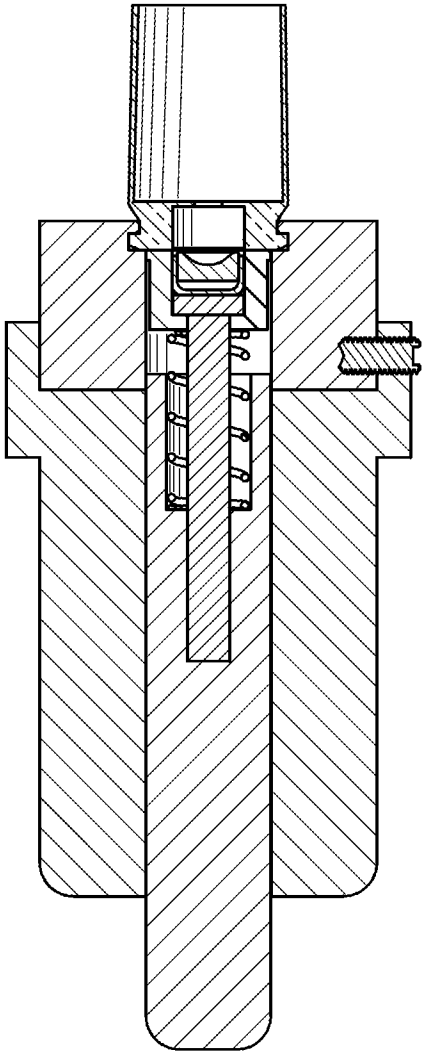
Figure 4A:
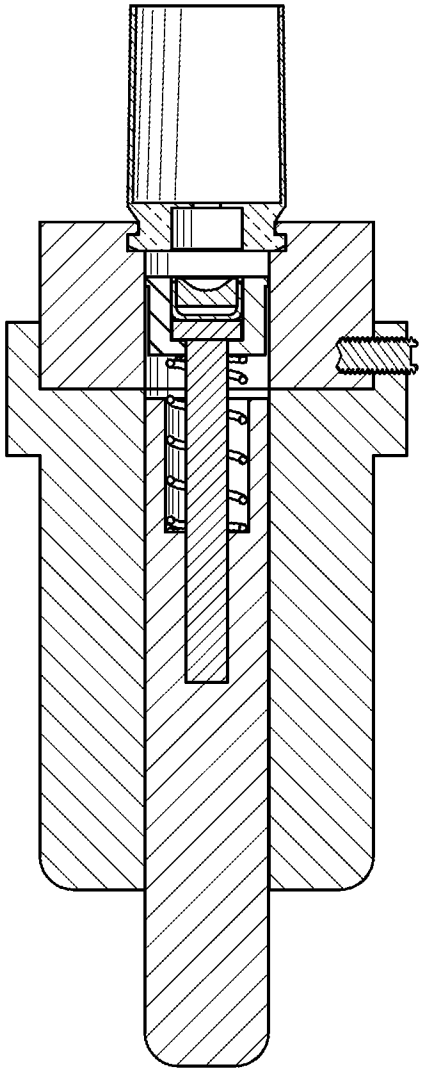

Current primer loading systems may seat a primer too deep into a primer pocket of a shell casing or not seat the primer deep enough into the primer pocket. Precision seating can be important because an improperly seated primer could result in a light fire or misfire when the firearm is discharged, and/or affect the accuracy of shooting.

The present invention provides a system and method for improving the accuracy of the seating of primers in primer pockets of shell casings while avoiding damaging the end of the shell casing or other parts of the primer seating tool. A stop mechanism is included such that, as the primer is inserted into the primer pocket, accurate seating depth is ensured. In addition, the seating depth may be adjusted in order to compensate for changes over time, which may be due to changes in materials or wear. Further, components that interact with the end of the shell casing may have increased thickness to add strength and provide more surface area relative to the base of the shell casing, thus reducing the chance that the base of the shell casing is bent or otherwise distorted during the priming, which further increases the accuracy and precision of the primer seating.

Prior art priming tools typically include a rod or ram that is configured to move up or down when an actuator is engaged, such as a lever or handle. The rod includes a threaded hole for receiving a primer plug or primer seating stem, which includes a primer holder at the top as well as a spring that surrounds the primer seating stem and is positioned at one end at the bottom of the primer holder and at the opposite end within the rod. A shell casing holder is positioned above the primer seating stem when the primer seating stem is secured in the rod. A primer is placed into the primer holder and then the lever is engaged such that the primer seating stem is drawn downward, and a shell casing is placed into the shell holder. With the shell casing in place, the lever is engaged in the opposite direction, causing the primer seating stem to move up toward the shell casing, and the primer is seated into the primer pocket of the shell casing as the top of the primer holder moves toward the primer holder. The primer holder is usually thin and does not serve as a stop during the seating process, as the seating depth is determined by the spring strength and/or the preset allowed linear motion of the rod. In some prior art designs, a mechanism is included for limiting the motion of the lever in order to prevent seating the primer too deeply, such as an adjustment screw that is positioned to limit the movement of the operating lever as disclosed in U.S. Pat. No. 5,693,905. In U.S. Pat. No. 9,303,965, a device for consistent placement of a primer in an ammunition shell is disclosed in which full extension of a loading pin is limited by an obstruction in the path of a ram rod within the ram chamber. However, this and similar mechanisms are too far removed from a structural perspective from the shell casing, primer, and primer holder to adequately ensure reliably consistent precise seating depth. Moreover, by setting the seating depth based on interactions of components that do not directly include the base of the shell, any variations in the base of the shell are not accounted for.

Turning to FIGS. 1-4C, in an embodiment of the present invention a primer loading tool 100 is provided that includes a rod 104 held within a rod support 101 that includes a threaded hole 108 and a top edge 110 around threaded hole 108. A primer seating stem 112 includes a threaded portion designed to be received by threaded hole 108 and a top portion 116 surrounded by a primer holder 120. Primer holder 120 may be a bushing cup or similar component that has an increased edge thicknesses (e.g., side and bottom) compared to prior art primer holders and a top surface 122 that is configured to engage with a base of a shell casing when a primer is seated. Primer seating stem 112 is configured to move through primer holder 120 as a primer is being seated in a primer pocket of a shell. A spring 124 surrounds primer seating stem 112 and is positioned at one end at the bottom of primer holder 120 and at the opposite end within threaded hole 108 of rod 104.

In operation, a shell casing 128 having a primer pocket 132 is placed into a shell casing holder 136 positioned above primer holder 120 and a primer 140 is placed into primer holder 120 (and on top portion 116 of primer stem 112). To seat primer 140 into primer pocket 132, rod 104 is engaged by a lever 144 or other mechanism causing upward motion and/or shell casing holder 136 is engaged causing downward motion, in either event resulting in top surface 122 of primer holder 120 being brought into contact with the base of shell casing 128 and top edge 110 of rod 104 contacting the bottom of primer holder 120, at which point primer 140 is accurately seated in primer pocket 132 (as shown in sequence in FIGS. 4A-4C). Seating depth is accurate and consistent because primer holder 120 serves as a stop when the appropriate seating depth is reached by being engaged on top surface 122 by the base of shell casing 128 and on the bottom surface by top edge 110 of rod 104, which are positioned such that they contact each other when the appropriate seating depth is reached. In this way, spring 124 cannot be further compressed, thus preventing seating the primer too deep. Further, the thickness of primer holder 120 is sufficient to prevent further motion even if additional pressure is applied to lever 144. In a preferred embodiment, the outside diameter of rod 104 and the outside diameter of primer holder 120 are equal or similar and the outside diameter of primer holder 120 is less than the diameter of the bottom portion of shell casing 128 that is engaged by top surface 122 of primer holder 120.

The seating depth may be fine-tuned by adjusting the depth primer seating stem 112 is placed in threaded hole 108. In a preferred embodiment, this depth may be further adjusted by a user by adjusting the depth of primer seating stem 112 within rod 104 by changing the location of a set screw 148 or similar within rod support 101.

In order to provide an appropriate stopping mechanism for precision primer seating depth, the primer holder and corresponding rod that will engage with each other to provide the stop must have relatively larger surface areas (compared to components in prior art primer seating tools) to provide greater strength of interactions. Further, the outside diameters of the rod and the primer holder may be substantially aligned during the priming process as well as aligned such that the primer holder's engagement with the base of the shell casing during seating includes interaction within the outside rim of the base of the shell casing, which further avoids or limits bending or damage to the shell when the rod, primer, primer seating stem, and primer holder act to seat the primer.

Figure 5:
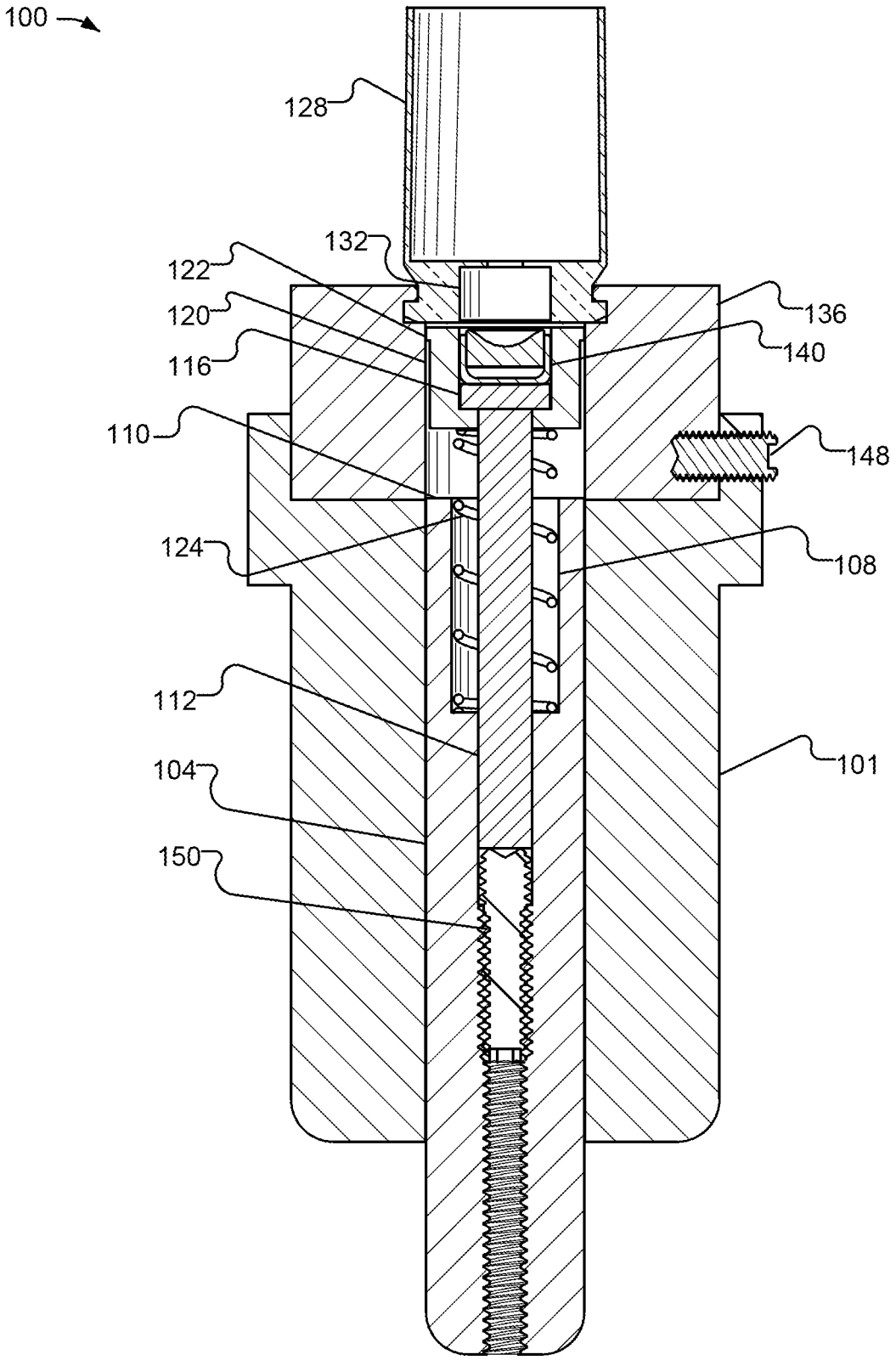
FIG. 5 is a cutaway view of a portion of a primer loading tool in accordance with another embodiment of the present invention.

Turning to FIG. 5, in another embodiment a primer loading tool 100 is provided that includes a rod 104 held within a rod support 101 that includes a threaded hole 108 and a top edge 110 around threaded hole 108. A primer seating stem 112 includes a threaded portion designed to be received by threaded hole 108 and a top portion 116 surrounded by a primer holder 120, which may be a bushing cup or similar component that has an increased edge thicknesses (e.g., side and bottom) compared to prior art primer holders and a top surface 122 that is configured to engage with a base of a shell casing when a primer is seated. A spring 124 surrounds primer seating stem 112 and is positioned at one end at the bottom of primer holder 120 and at the opposite end within threaded hole 108 of rod 104.

In operation, a shell casing 128 having a primer pocket 132 is placed into a shell casing holder 136 positioned above primer holder 120 and a primer 140 is placed into primer holder 120 (and on top portion 116 of primer stem 112). To seat primer 140 into primer pocket 132, rod 104 is engaged by a lever 144 or other mechanism causing upward motion and/or shell casing holder 136 is engaged causing downward motion, in either event resulting in top surface 122 of primer holder 120 being brought into contact with the base of shell casing 128 and top edge 110 of rod 104 contacting the bottom of primer holder 120, at which point primer 140 is accurately seated in primer pocket 132. Seating depth is accurate and consistent because primer holder 120 serves as a stop when the appropriate seating depth is reached by being engaged on top surface 122 by the base of shell casing 128 and on the bottom surface by top edge 110 of rod 104, which are positioned such that they contact each other when the appropriate seating depth is reached. In this way, spring 124 cannot be further compressed, thus preventing seating the primer too deep. Further, the thickness of primer holder 120 is sufficient to prevent further motion even if additional pressure is applied to lever 144. In a preferred embodiment, the outside diameter of rod 104 and the outside diameter of primer holder 120 are equal or similar and the outside diameter of primer holder 120 is less than the diameter of the bottom portion of shell casing 128 that is engaged by top surface 122 of primer holder 120.

The seating depth may be fine-tuned by adjusting the depth primer seating stem 112 is placed in threaded hole 108. In a preferred embodiment, threaded hole 108 runs to the bottom of rod 104 and the depth may be adjusted by a user by adjusting the depth of primer seating stem 112 within rod 104 by changing the positioning of a stop 150 within hole 108, which can be accessed via the bottom of rod 104.

Figure 6:
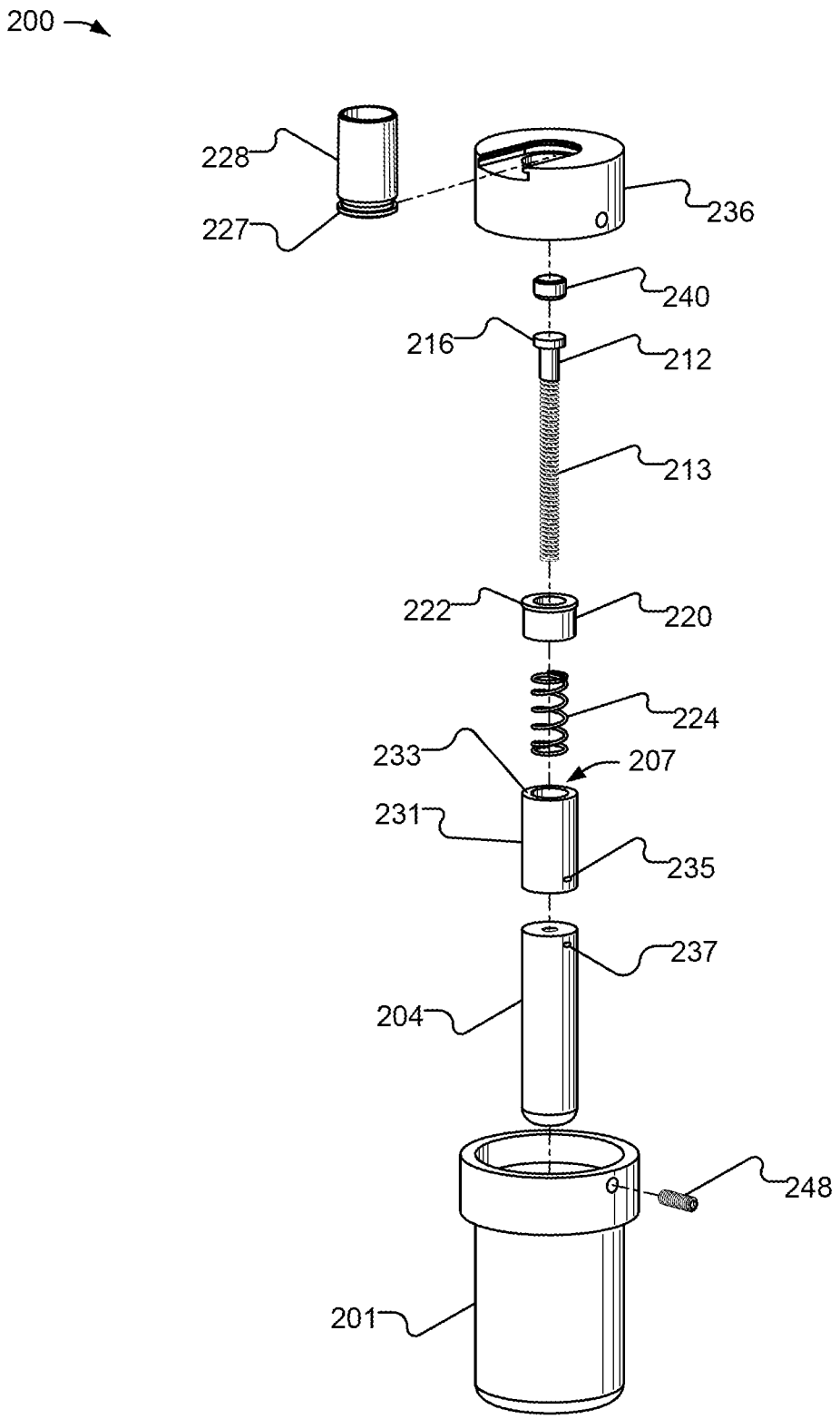
FIG. 6 is a cutaway view of a portion of a primer loading tool in accordance with another embodiment of the present invention.
Figure 7:
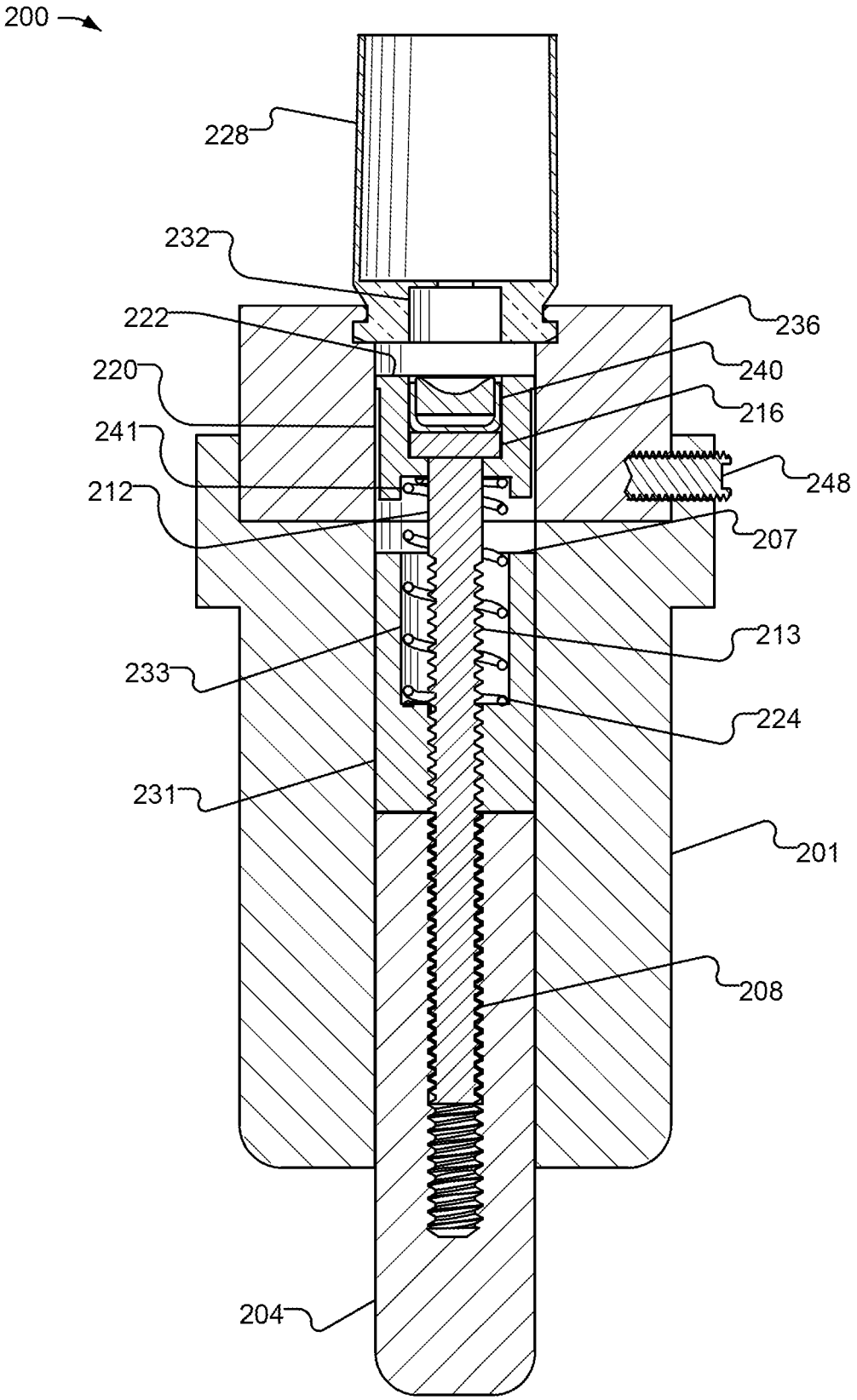
FIG. 7 is an exploded perspective view of the primer loading tool of FIG. 6.

Turning to FIGS. 6-7, in another embodiment, a primer loading tool 200 is provided that includes a rod 204 held within a rod support 201 and includes a threaded hole 208. A locking ring 231 is configured to engage with a top of rod 204 and includes a top surface 207. A primer seating stem 212 includes a threaded portion 213 designed pass through locking ring 231 and to be received by threaded hole 208. Stem 212 includes a top portion 216 configured to rest within and be surrounded by a primer holder 220, which may be a bushing cup or similar component that has an increased edge thicknesses (e.g., side and bottom) compared to prior art primer holders. Primer holder 220 includes a top surface 222 that is configured to engage with a base 227 of a shell casing 228 when a primer is seated. A spring 224 surrounds primer seating stem 212 and is positioned between the bottom of primer holder 220 (which may include a recess 241 for receiving spring 224) and locking ring 231 (which may also include a recess 233 for receiving spring 224). In addition, locking ring 231 may include a hole 235 that can be aligned with a hole 237 on rod 204 and locked via a set screw 248 or similar.

In operation, a shell casing 228 having a primer pocket 232 is placed into a shell casing holder 236 positioned above primer holder 220 and a primer 240 is placed into primer holder 220. To seat primer 240 into primer pocket 232, rod 204 is engaged by a lever or other mechanism (not shown in FIGS. 6-7) causing upward motion and/or shell casing holder 236 is engaged causing downward motion, in either event resulting in top surface 222 of primer pocket holder 232 being brought into contact with base 227 of shell casing 228 and the bottom surface of primer pocket holder 232 is engaged by top surface 207 of locking ring 231, at which point primer 240 is accurately seated in primer pocket 232 via the action of spring 224. Seating depth is accurate and consistent because primer holder 220 serves as a stop when the appropriate seating depth is reached by being engaged on top surface 222 by base 227 of shell casing 228 and on the bottom surface by top edge 207 of locking ring 231, which are positioned such that they contact each other when the appropriate seating depth (with top portion 216 extending to base 227) is reached. In this way, spring 224 cannot be further compressed, thus preventing seating the primer too deep. Further, the thickness of primer holder 220 is sufficient to prevent further motion even if additional upward pressure is applied to rod 204. In a preferred embodiment, the outside diameter of primer holder 220 are equal or similar and the outside diameter of primer holder 220 is less than the diameter of bottom portion 227 of shell casing 228 that is engaged by top surface 222 of primer holder 220.

The seating depth may be fine-tuned by adjusting the depth primer seating stem 212 is placed in threaded hole 208. In a preferred embodiment, this depth may be adjusted by a user by adjusting the depth of primer seating stem 212 within rod 204 by changing the location of a set screw 248 or similar within rod support 201. For the most accurate seating depth, the gap between top surface 207 of locking ring 231 and the bottom of primer holder 220 will be the same as the depth of primer pocket 232 so that will equal the distance traveled by stem 212 during primer 240 insertion. By having the primer seating motion of primer stem 212 stopped based in part on the engagement of top surface 222 of primer holder 220 with bottom surface 227 of shell casing 228, seating depth is improved because any variations in the thickness of the rim of shell casing 228 are accounted for.

Figure 8C:
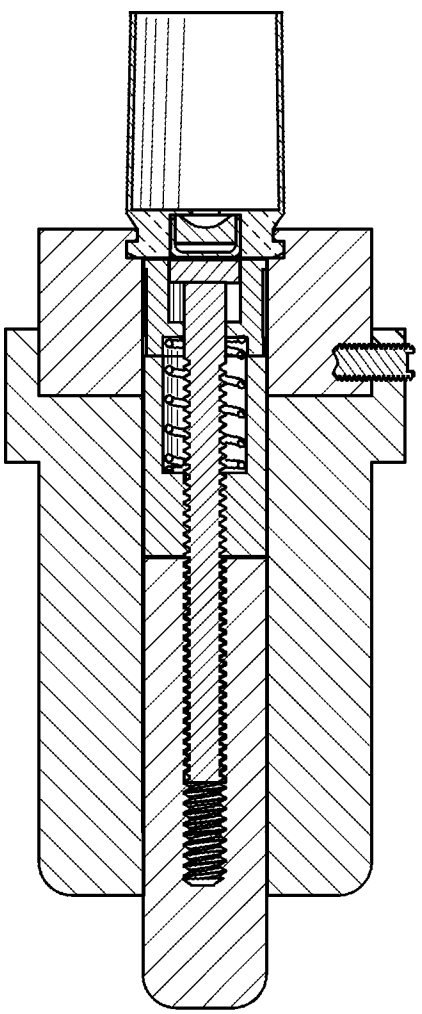
FIGS. 8A-8C are cutaway views of a portion of the primer loading tool of FIG. 6 showing different stages in the primer loading sequence.
Figure 8B:
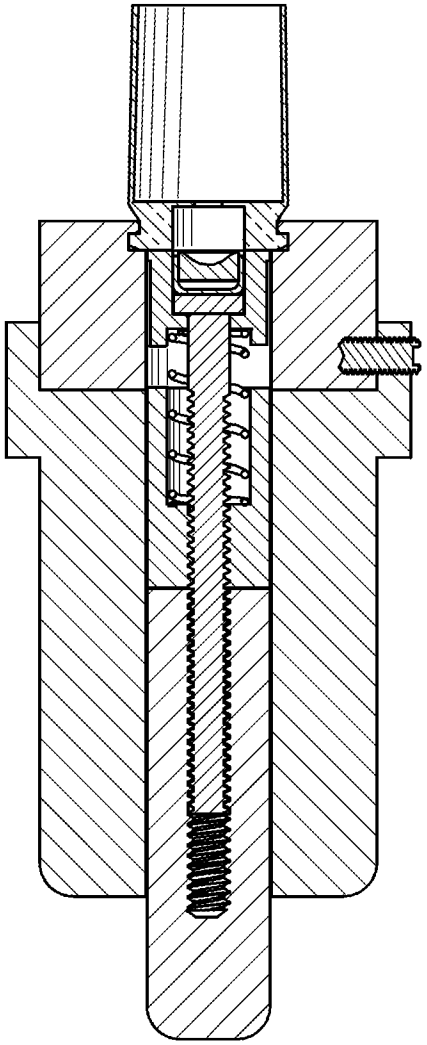
Figure 8A:
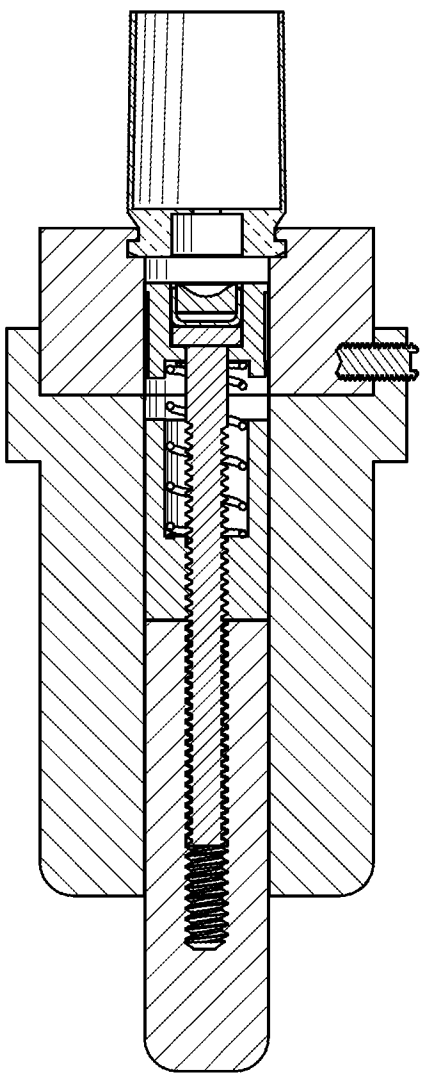

In operation, a primer 240 is positioned over the top opening of primer holder 220, either singly or by a primer ribbon or primer wheel while stem 212 is in a lower position. As stem 212 is raised, primer 240 is lifted on top surface 216 (which is within a primer holder 220) and as stem 212 is further raised, passes through primer holder 220 and into primer pocket 232 when a shell casing 228 is in shell holder 236. As shown in FIGS. 8A-8C, the upward motion of rod 204 is limited by the engagement of top edge 222 of primer holder 220 with bottom surface 227 of shell casing 228 coupled with the engagement of top surface 207 of locking ring 231 with the bottom of primer holder 220. In this way, precise and accurate seating depth of a primer into a primer pocket can be easily and consistently accomplished. The depth can be adjusted to within a few thousandths of an inch (i.e., 10-50 microns) by adjusting the distance rod 204 is located within rod support 201 with a set screw 228 and/or stem 212 with respect to rod 204 via locking ring 231. Because small variations in the size of the rim of the shell casing, including variations in the thickness of the rim and/or variations due to the rim being bent, are of sufficient magnitude to impact seating depth enough to affect the accuracy of shooting, seating primers by engaging the rim directly in order to determine seating depth improves accuracy.

Exemplary embodiments have been disclosed above and illustrated in the accompanying drawings. It will be understood by those skilled in the art that various changes, omissions, and additions may be made to that which is specifically disclosed herein without departing from the spirit and scope of the present invention.

What is claimed is:

1. A primer seating device comprising:

a shell casing holder for receiving a shell casing, wherein the shell casing has a bottom end, the bottom end having a shell casing end diameter, and a primer pocket at the bottom end;

a rod having a top end and a bottom end, the rod including a threaded hole running from the top end toward the bottom end, wherein the rod has a diameter that is smaller than the shell casing end diameter;

a primer seating stem having a top portion and a bottom portion, wherein the bottom portion includes a threaded portion and is configured to be received by the threaded hole and wherein the top end is encompassed by a primer holder, the primer holder having a top edge and a bottom edge, and having an outer diameter equal to the diameter of the rod;

a spring surrounding a portion of the primer seating stem from the top portion of the primer seating stem to a lower portion located within the rod when the primer seating stem is secured in the rod; and a lever positioned beneath the rod and configured to raise the rod toward the shell casing holder when actuated, wherein, when the rod is raised by the lever, the rod and the primer seating stem move upward until the top edge of the primer holder contacts the shell casing end and the bottom edge of the primer holder contacts the top end of the rod such that upward motion of the rod is terminated.

2. The primer seating device of claim 1, wherein the threaded hole runs through the bottom end of the rod.

3. The primer seating device of claim 2, further including a set screw in the threaded hole.

4. A primer seating device for seating a primer in a shell casing, the shell casing including a bottom end and a primer pocket, the primer seating device comprising:

a shell casing holder for receiving the shell casing;

a rod having a top end and a bottom end, the rod including a threaded hole running from the top end toward the bottom end, wherein the top end includes a top edge;

a primer seating stem having a top portion and a bottom portion, wherein the bottom portion includes a threaded portion and is configured to be received by the threaded hole and wherein the top end is configured to support the primer;

a primer holder configured to surround the top portion of the primer seating stem and support the primer, wherein the primer seating stem is configured to move upwardly with respect to the primer holder;

a locking ring between the rod and the primer holder, wherein a portion of the primer seating stem passes through the locking ring, wherein the locking ring is rigidly secured to the top end of the rod, and wherein the locking ring includes a top surface;

a spring surrounding a portion of the primer seating stem from the top portion of the primer seating stem to a lower portion of the primer seating stem located within the locking ring; and a lever positioned beneath the rod and configured to raise the rod toward the shell casing holder when actuated, wherein, when the rod is raised by the lever, the top surface of the locking ring contacts a bottom surface of the primer holder and a top surface of the primer holder contacts the bottom end of the shell casing when the shell casing is in the shell casing holder such that upward motion of the rod is terminated.

5. The primer seating device of claim 4, wherein the primer holder includes a recess for receiving a portion of the spring.

6. The primer seating device of claim 5, wherein the locking includes a recess for receiving a portion of the spring.

7. The primer seating device of claim 4, wherein, when the locking ring is in a fully lowered position, a gap between the bottom surface of the primer holder and the top surface of the locking ring equals a desired seating depth of the primer in the primer pocket.

8. The primer seating device of claim 4, wherein the primer holder includes a shelf for engaging the top portion of the primer seating stem such that downward motion of the primer seating stem is limited with respect to the primer holder.

9. A primer seating device comprising:

a shell holder configured to receive a shell, wherein the shell includes a primer pocket and a bottom rim surrounding the primer pocket, wherein the shell holder is configured to secure the shell such that the primer pocket is oriented toward the shell holder, and wherein the shell holder includes an opening aligned with the primer pocket when the shell is in the shell holder;

a stem configured to move from a first position to a second position, the stem having a diameter, a threaded lower portion, and a top portion being wider than the diameter of the stem;

a primer holder configured to hold a primer and including a top surface and a lower surface and configured to receive the stem, wherein, when the stem is in the primer holder, the top portion of the stem is supported by the primer holder when the stem is in the first position and the stem is configured to move with respect to the primer holder into the second position;

a locking ring through which the threaded lower portion of the stem runs;

a rod having an upper surface and a threaded hole configured to receive the threaded lower portion of the stem; and a spring surrounding a portion of the stem beneath the top portion of the stem and operably positioned between the primer holder and the locking ring, wherein the primer holder includes a recess for receiving the spring and the locking ring includes a recess for receiving the spring, wherein the primer holder has a diameter that is less than a diameter of the bottom rim of the shell, wherein a maximum extent of the second position is limited by engagement of the upper surface of the rod with the lower surface of the primer holder and the top surface of the primer holder with the bottom rim of the shell when the shell is in the shell holder, and wherein a depth of the stem in the threaded hole is adjustable and is fixed by the locking ring.

10. The primer seating device of claim 9, wherein the rod and the locking ring are housed in a rod support through which the rod moves when engaged by a force from below.

11. The primer seating device of claim 10, wherein the primer holder includes a ledge for supporting the top portion of the stem.

* * * * *